US007059374B2

(12) United States Patent
Mitsui et al.

(10) Patent No.: US 7,059,374 B2
(45) Date of Patent: Jun. 13, 2006

(54) TRANSFER DEVICE

(75) Inventors: Takashi Mitsui, Osaka (JP); Hideto Shima, Kyoto (JP)

(73) Assignee: Kokuyo Co., Ltd. (JP)

( * ) Notice: Subject to any disclaimer, the term of this patent is extended or adjusted under 35 U.S.C. 154(b) by 0 days.

(21) Appl. No.: 11/006,541

(22) Filed: Dec. 8, 2004

(65) Prior Publication Data

US 2005/0139327 A1 Jun. 30, 2005

(30) Foreign Application Priority Data

Dec. 26, 2003 (JP) ..... P2003-435445

(51) Int. Cl.
*B65H 35/07* (2006.01)
*B43L 19/00* (2006.01)

(52) U.S. Cl. ..... 156/523; 156/577; 156/579; 118/76; 242/160.4; 242/171; 242/588.6

(58) Field of Classification Search ..... 156/523, 156/527, 538, 540, 574, 577; 118/76, 200, 118/257; 225/46; 242/160.2, 160.4, 170, 242/171, 588, 588.2, 588.3, 588.6; D19/67, D19/68, 69
See application file for complete search history.

(56) References Cited

U.S. PATENT DOCUMENTS

D449,858 S * 10/2001 Liu ..... D19/69
6,321,815 B1 * 11/2001 You ..... 156/577
D465,241 S * 11/2002 Suzuki ..... D19/69
D466,158 S * 11/2002 Suzuki ..... D19/69
D475,746 S * 6/2003 Ono ..... D19/69
D475,747 S * 6/2003 Ono ..... D19/69
D485,302 S * 1/2004 Bain ..... D19/69
2003/0062135 A1 * 4/2003 Takahashi ..... 156/577
2005/0056374 A1 * 3/2005 Marschand et al. ..... 156/540

FOREIGN PATENT DOCUMENTS

JP 2002-178694 A 6/2002
JP 2003-54190 * 2/2003

* cited by examiner

*Primary Examiner*—Mark A. Osele
(74) *Attorney, Agent, or Firm*—Banner & Witcoff, Ltd.

(57) ABSTRACT

A transfer device comprises a transfer head K that makes transfer paste T contact with a target object such as a paper or a leaf to which the transfer paste T is to be transferred, a pair of side panels 11, 12 that tightly hold the transfer head K and the transfer paste T, and a head cap C that is rotatable between a transfer head covering position (P) where a distal end portion Ka of the transfer head K can be covered and a transfer head expose position (q) where the distal end portion Ka of the transfer head K can be exposed, wherein a rotary support shaft C11 arranged on the head cap C is axially mounted on through holes 110*a*, 120*a* formed on the side panels 11, 12 and the head cap C is tightly held by the side panels 11, 12.

18 Claims, 7 Drawing Sheets

(a)

(b)

(c)

(a)

(b)

(c)

(a)

(b)

TRANSFER DEVICE

BACKGROUND OF THE INVENTION AND RELATED ART STATEMENT

This invention relates to a transfer device that is used for transferring a transferring material on an object on which the transferring material is to be transferred.

Various transfer devices have been conceived that are used in case of transferring a transferring material such as a tape like an adhesive tape or a non-adhesive tape, a solid or liquid paste or a binding agent on an object on which the transferring material is to be transferred such as papers or leaves. For example, a known transfer device comprises a refillable cartridge that can hold a transferring material and a transfer head to make the transferring material contact with an object on which the transferring material is to be transferred, and a case that accommodates the refillable cartridge detachably. In accordance with this arrangement, when all of the transferring material is used up or the transfer head is broken, commonly (for example, refer to patent document 1) the refillable cartridge is dismounted from the case and the dismounted refillable cartridge is exchanged with a new refillable cartridge comprising a new transferring material and a new transfer head. In addition, it is conceived that at least when the transfer device is not in use, a distal end portion of a transfer head is covered, a head cap protecting a transferring material is axially mounted on the transfer head and the head cap is arranged to be rotatable around a rotational supporting axis.

(Patent Document 1) Japan Patent Laid Open number 2002-178694 (FIG. 2)

However, a case wherein the head cap is axially mounted on the transfer head will cause following problems. More specifically, commonly the transferring material and the transfer head are tightly held by a pair of side panels constituting an outside wall of the refillable cartridge and a predetermined space is formed at a relevant portion between the side panels in order to secure a passage to introduce the transferring material to the transfer head. As a result, no component to connect the side panels exists at a front end portion of the transfer device, which reduces strength at the front end portion of the transfer device. Then each side panels may bend when the side panels are held by a strong force at a time that the transfer device is in use or the transfer device falls. Other conceivable arrangement of the transfer device is that a head cap is axially mounted on a front end portion of a case. With this arrangement, when a head cap is required to be exchanged such that a transferring material attaches to the head cap or the head cap is broken, the head cap has to be exchanged in addition to an operation of exchanging a refillable cartridge. The additional operation is troublesome and is lacking in practicality. In addition, when the head cap is mounted on the case, an operation of the head cap to evacuate to a predetermined position is required every time the refillable cartridge is exchanged in order to avoid interference of the head cap with the transfer head in exchanging the refillable cartridge, which hinders a smooth operation of exchanging the refillable cartridge.

In order to solve the above-mentioned problems, the present claimed invention mainly intends to provide a transfer device wherein strength of an area adjacent to a portion where a transfer head is arranged is effectively improved with a simple arrangement.

SUMMARY OF THE INVENTION

The transfer device of the present claimed invention is a transfer device used for transferring a transferring material on an object on which the transferring material is to be transferred, and is characterized by comprising a transfer head that makes the transferring material contact with the object, a pair of side panels that hold the transfer head and the transferring material, and a head cap rotatable between a transfer head covering position where a distal end portion of the transfer head can be covered and a transfer head exposing position where the distal end portion of the transfer head can be exposed, wherein a rotational supporting axis arranged on either a pair of the side panels or the head cap is axially mounted on a bearing portion formed at the other of a pair of the side panels or the head cap and the head cap is tightly held by a pair of the side panels.

In accordance with this arrangement, since the rotational supporting axis is located between a pair of the side panels even though a predetermined space is formed between a pair of the side panels in an area adjacent to a position where the transfer head is arranged in order to introduce the transferring material into the transfer head from inside the transfer device, the rotational supporting axis performs a function to directly connect the side panels, thereby to improve a connecting strength between the side panels in an area adjacent to the transfer head and also to improve rigidity of the transfer device itself. As a result, a problem that a pair of the side panels bend to approach each other when the transfer device is in use or the transfer device falls can be effectively avoided with a simple arrangement, thereby to improve usability. In addition, there is no need of an elaborate operation to mount the head cap on the transfer head, thereby to promote the efficiency of assembling the transfer device. "The distal end portion of the transfer head is covered" includes not only all of the distal end portion of the transfer head is covered but also a part of the distal end portion of the transfer head is covered.

In addition, if the transfer device is so arranged to comprise a refillable cartridge that holds the transferring material, the transfer head and the head cap between a pair of the side panels, and a case that accommodates the refillable cartridge detachably, the head cap can be exchanged together with the transfer head by exchanging the refillable cartridge. In order to secure a good rotary movement of the head cap, the head cap may be so set not to interfere the case while the head cap is in motion to make a rotary movement between the transfer head covering position and the transfer head exposing position.

In addition, if the refillable cartridge is so arranged to be detachable from the case in either case that the head cap is located at the transfer head covering position or the transfer head exposing position, there is no need of a troublesome operation of the head cap to evacuate to a predetermined position every time the refillable cartridge is exchanged so that the head cap does not interfere the case in exchanging the refillable cartridge, thereby to make an operation of exchanging the refillable cartridge smooth.

The head cap comprises an accommodating portion that can accommodate the distal end portion of the transfer head at the transfer head covering position and an arm that extends from the accommodating portion toward the rotational supporting axis and can cover a portion which is to be used of the transferring material at the transfer head covering position, and an operating portion to which a user can hook his or her finger in operating the head cap to make a rotary movement is arranged in the accommodating portion is represented as a preferable mode of the head cap. In this case, if the operating portion is integrally formed with the accommodating portion, a number of components can be reduced compared with a case wherein the operating portion is formed with a separate component.

If the rotational supporting axis is integrally formed with a pair of the side panels or the head cap, both a number of components and a cost can be reduced, and an operation of mounting the rotational supporting axis on the head cap can be effectively simplified.

In order to protect the transferring material by engaging the head cap at the transfer head covering position when the transfer device is not in use, the head cap is restricted from making a rotary movement through a first engaging means that engages the head cap with the transfer head at the transfer head covering position.

Meanwhile, if the head cap is restricted from making a rotary movement through a second engaging means that engages the head cap with the side panel at the transfer head exposing position, the head cap is prevented from making a rotational movement improperly when the transfer device is in use, thereby to improve usability.

In order to form the first engaging means with a simple arrangement, it is preferable that the first engaging means comprises a convex portion arranged at either one of the head cap and the transfer head, and a fitting concave portion that is arranged at the other and that can fit over the convex portion. Likewise, if the second engaging means is formed by comprising a convex portion arranged at either one of the head cap and the side panel and a fitting concave portion that is arranged at the other and that can fit over the convex portion, the second engaging means can be formed with a simple arrangement and a state of engagement between the head cap and the side panels can be improved as well.

Especially, in order to form the fitting concave with a simple arrangement, it is preferable that the fitting concave is a through bore penetrating toward a direction of a thickness. In order to produce the same effect, the fitting concave is formed by denting an adjacent area of a predetermined area.

If an elastic portion that can bend due to a force applied from outside is arranged at a predetermined area of a member that has the fitting concave portion and the fitting concave portion is arranged at a predetermined portion of the elastic portion, the elastic portion interferes with the convex portion transitionally while the head cap is in motion to make a rotary movement and further rotation of the head cap makes the elastic portion bend, which gives an appropriate click feeling when the convex portion fits into the fitting concave portion formed on the elastic portion. As a result, a nice touch of operation can be obtained, and an engaged state of the fitting concave portion and the convex portion can be improved. In this case, if a predetermined slit is arranged at an adjacent area of the elastic portion, it is possible to give the elastic portion elasticity with a simple arrangement.

DETAILED DESCRIPTION OF THE PREFERRED EMBODIMENTS

An embodiment of the present claimed invention will be described in detail with reference to the accompanying drawings.

A transfer device A in accordance with this embodiment accommodates, as shown in FIG. 1 through FIG. 4, a tape body Ta and a transferring paste T as being a transferring material that is adhered to a single face of the tape body Ta in a predetermined pattern and is used for transferring the transferring paste T on an object on which the transferring paste T is to be transferred such as papers or leaves, not shown in drawings.

The transfer device A comprises a refillable cartridge 1 that holds the transferring paste T, a case 2 that accommodates the refillable cartridge 1 detachably, and a sliding member 3 that is mounted on the case 2 and that can make a sliding movement relative to the case 2. It is so arranged that a refillable cartridge 1 having a used transferring paste T can be separated from the case 2 and a new refillable cartridge 1 having a new transferring paste T can be mounted on the case 2. In order to do so, the transfer device A is so arranged that the refillable cartridge 1 and the case 2 can be separated through a separating mechanism X that separates the refillable cartridge 1 linearly toward a direction orthogonal to a direction of a sliding movement of the sliding member 3 in conjunction with the sliding movement of the sliding member 3. In the following explanation, a term "front" showing a position or a direction indicates a side where a transfer head K is located, and a term "back" indicates an opposite side to the position where the transfer head K is located. In addition, "a direction along back and forth" indicates a longitudinal direction of the transfer device A.

Figure 1:
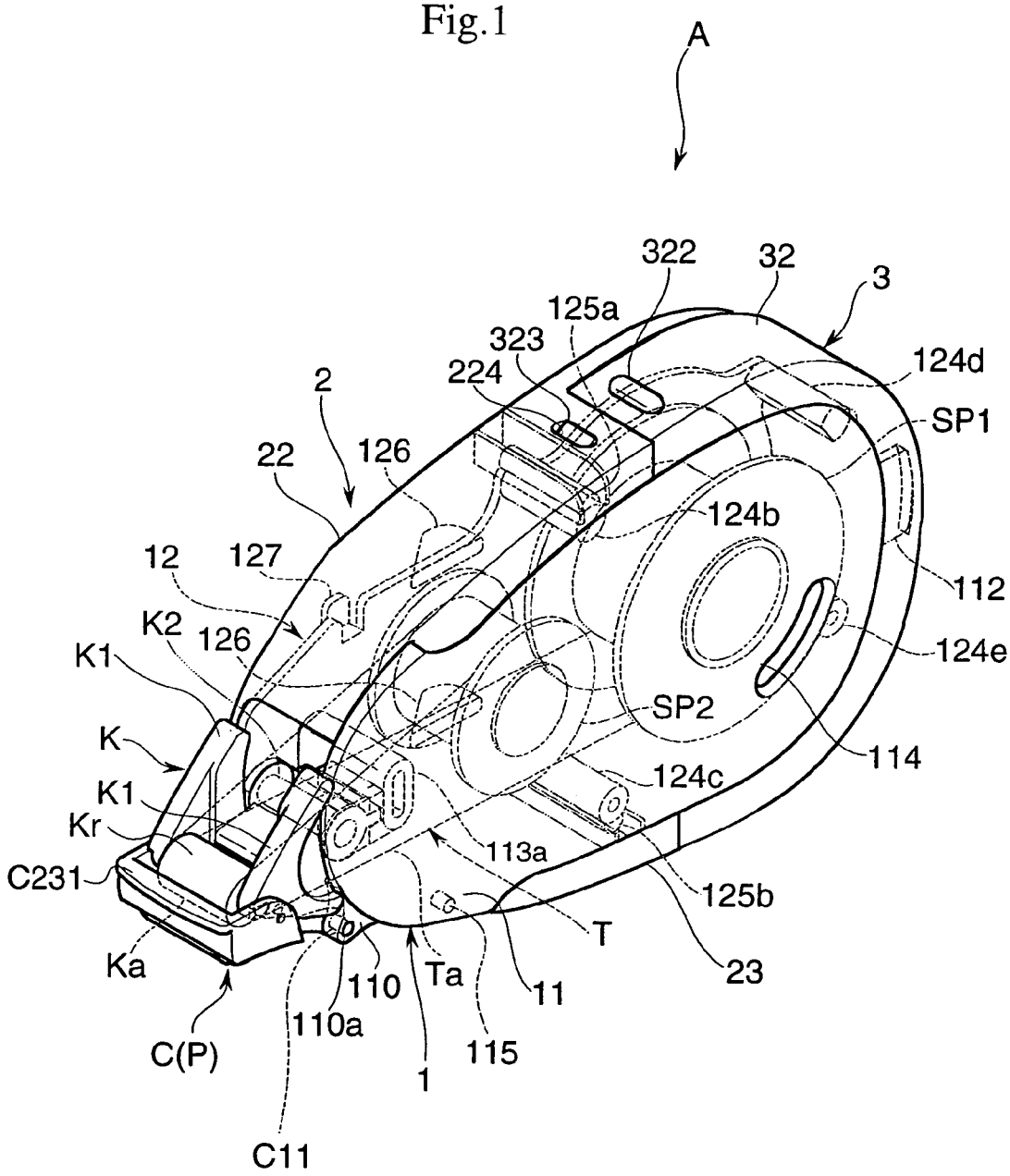
FIG. 1 is a general perspective view showing a transfer device in accordance with one embodiment of the present claimed invention.
Figure 2:
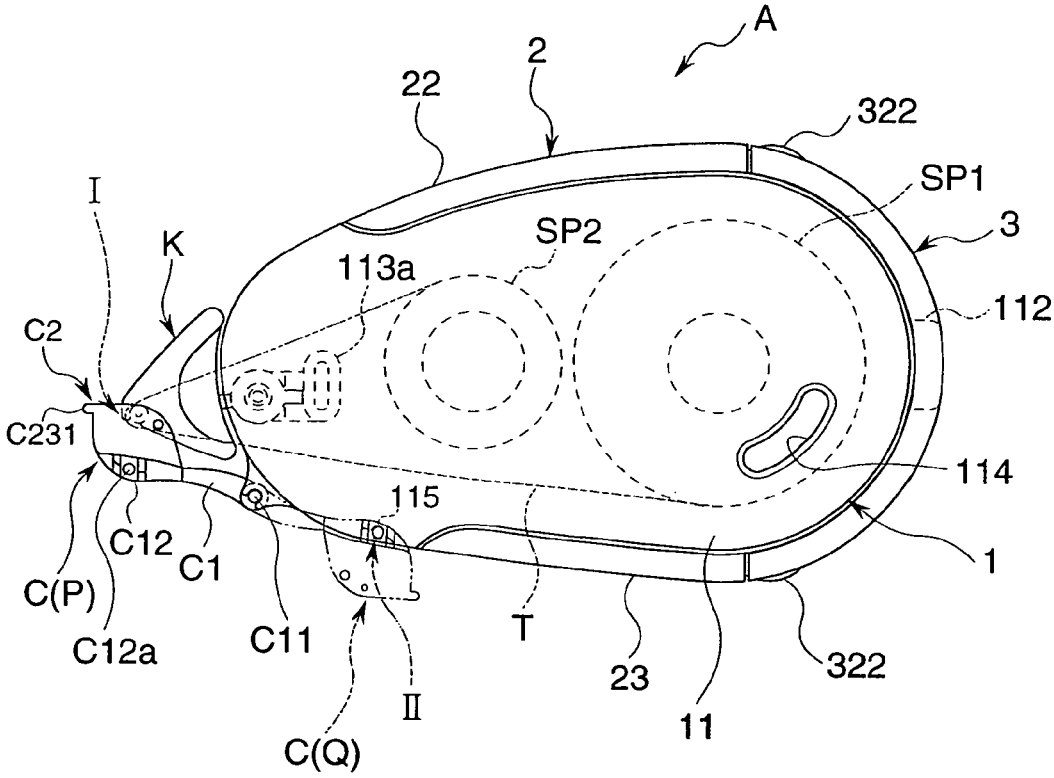
FIG. 2 is a side view of the transfer device in accordance with the embodiment wherein a part of the transfer device is omitted to draw.
Figure 3:
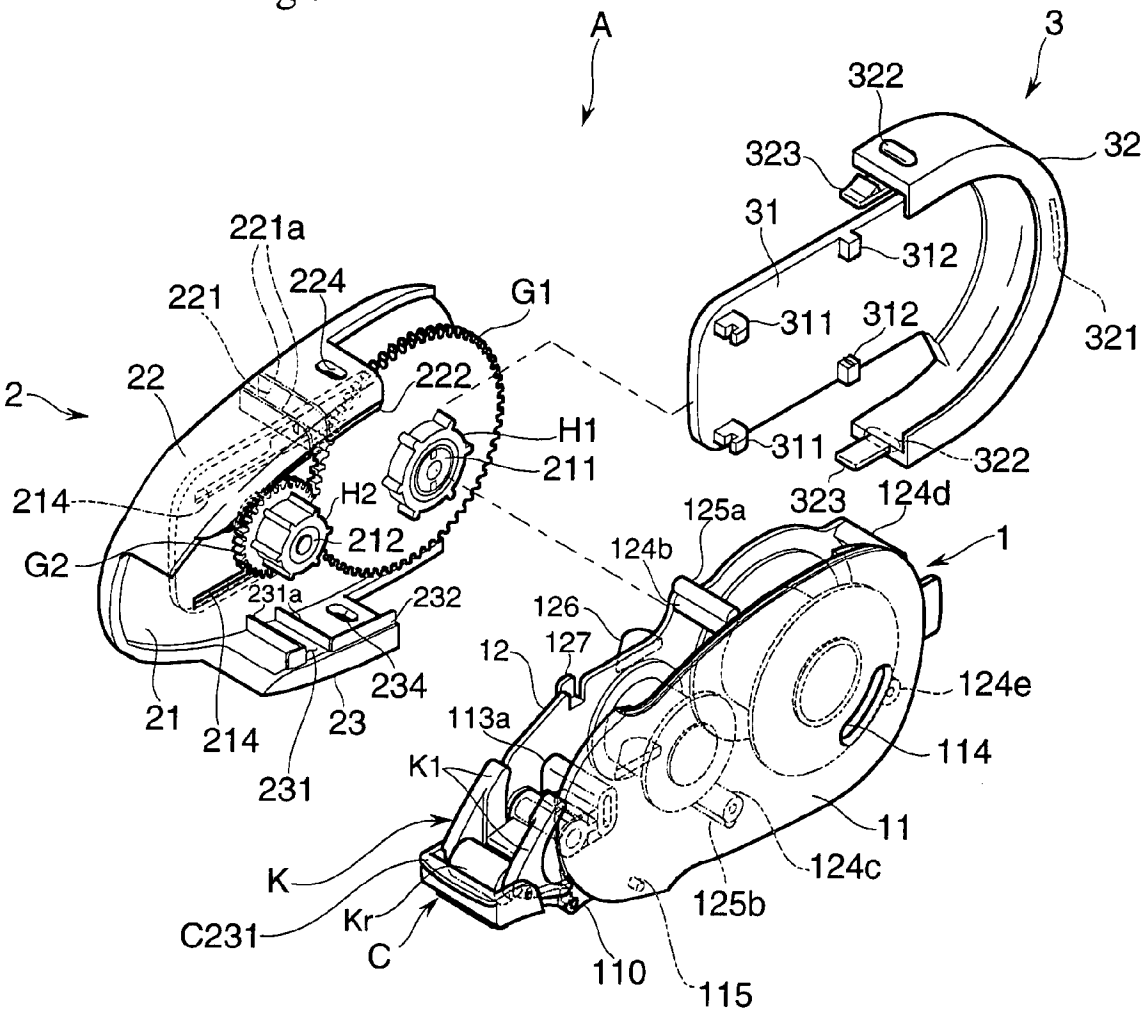
FIG. 3 is an exploded perspective view of the transfer device in accordance with the embodiment.

The refillable cartridge 1 comprises mainly, as shown in FIG. 1 through FIG. 4, a second outside panel 11 as being one of outer walls of the transfer device A, and an inside panel 12 arranged to face the second outer panel 11. The refillable cartridge 1 holds the transferring paste T mounted on a wind-off spool SP1 and a roll-up spool SP2, the transfer head K that makes the transferring paste T contact with a surface of papers or leaves, and a head cap C that can be rotatable between a transfer head covering position (P) where a distal end portion Ka of the transfer head K can be covered and a transfer head exposing position (Q) where the distal end portion Ka of the transfer head K can be exposed between the second outside panel 11 and the inside panel 12. (Refer to FIG. 2). The second outside panel 11 and the inside panel 12 correspond to "a pair of the side panels" in the present claimed invention. FIG. 1 shows the transfer device A in a state that the head cap C is located at the transfer head covering position (P).

Figure 4:
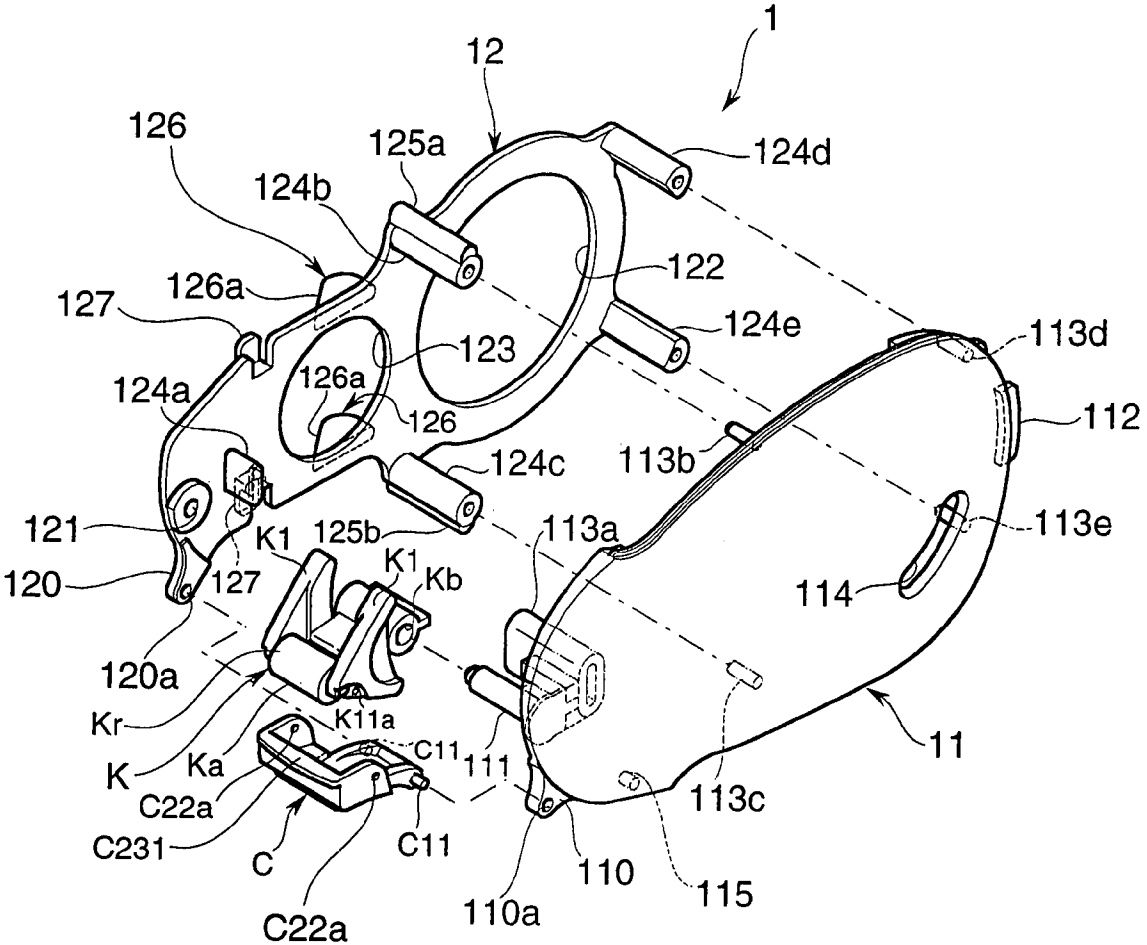
FIG. 4 is an exploded perspective view showing a refillable cartridge in accordance with the embodiment.

The second outside panel 11 is, for example, in a shape of a thin plate made of synthetic resin and in this embodiment, is in a general egg-shape in a side view as shown in FIG. 4. A thin plate-shaped elongated portion 110 that extends downward at an angle is arranged at a front end portion of the second outside panel 11 and a through bore 110*a* as being a bearing portion of the present claimed invention into which a rotational supporting axis C11 of the head cap C can be inserted is formed at a general center portion of the elongated portion 110. A supporting shaft 111 that can support the transfer head K is formed to project toward a direction of the inside panel 12 at a front end portion of the inside face of the second outside panel 11. A bore portion Kb into which the supporting shaft 111 is inserted is formed on the transfer head K. Furthermore, a fitting nail 112 is arranged to project rearward at a rear end portion of the second outside panel 11 and the fitting nail 112 is so set to fit into a fitting bore 321, to be described later, formed on the sliding member 3 when the transfer device A is in use (when the sliding member 3 is located at a position where a sliding movement starts). In addition, a convex portion 115 is integrally formed to project toward the inside panel 12 at a lower end portion of the front end portion on an inner face of the second outside panel 11. The convex portion 115 is a small projection in a general column shape and is so set to fit into a concave portion C12*a*, to be described later, of the head cap C in case that the head cap C is located at the transfer head exposing portion (Q). In addition, supporting concave portions, not shown in drawings, each of which supports the wind-off spool SP1 and the roll-up spool SP2 respectively in a rotatable manner, are formed at predetermined areas in an inner face of the second outside panel 11. The predetermined areas are areas to which one side end portion of the wind-off spool SP1 and the roll-up spool SP2 whose other side end portion is supported by the inside panel 12 can make an abutting contact with or can be close to.

The inside panel 12 is, for example, in a shape of a thin plate made of synthetic resin and in this embodiment, a rear end side of the inside panel 12 is a partial ark in a side view and a front end side of the inside panel 12 is a general square in a side view. Like the second outside panel 11, an elongated portion 120 that extends downward at an angle is arranged at a front end portion of the inside panel 12 and a through bore 120*a* as being a bearing portion of the present claimed invention, into which the rotational supporting axis C11 of the head cap C can be inserted, is formed at a general center portion of the elongated portion 120. In a state that the inside panel 12 and the second outside panel 11 are assembled, the elongated portion 120 faces the elongated portion 110. Then the head cap C can make a rotary movement around the rotational supporting axis C11 by inserting the rotational supporting axis C11 into the through bore 110*a* of the elongated portion 110 and the through bore 120*a* of the elongate portion 120. A concrete explanation about the head cap C will be described later. A bore 121 is formed at a front end portion of the inside face of the inside panel 12 to accept a distal end portion of the supporting shaft 111 formed on the second outside panel 11. In addition, supporting bores 122, 123 that can support each of the wind-off spool SP1 and the roll-up spool SP2 in a rotatable manner are formed to open at a rear end portion side and a center portion of the inside panel 12 respectively. A diameter of the supporting bore 122 for the wind-off spool SP1 is made to be larger than a diameter of the supporting bore 123 for the roll-up spool SP1 in order to correspond to each diameter of the wind-off spool SP1 and the roll-up spool SP2 respectively. Each of the wind-off spool SP1 and the roll-up spool SP2 is in a general cylindrical shape with a fringe integrally formed and supported between the inside panel 12 and the second outside panel 11 in a rotatable manner with each of one end portion thereof inserted into the supporting bores 122, 123 and each of the other end portion thereof inserted into the supporting concave.

The second outside panel 11 and the inside panel 12 are in a fitting arrangement, as shown in FIG. 4. In order to do so, a cylindrical portion 113*a* and small projections 113*b*, 113*c*, 113*d*, 113*e* are formed at an inside face of the second outside panel 11 to project toward the inside panel 12 and a small projection 124*a*, which can fit into the cylindrical portion 113*a*, and cylindrical portions 124*b*, 124*c*, 124*d*, 124*e*, each of which can fit over each of the small projections 113*b*, 113*c*, 113*d*, 113*e* respectively are formed at an inside face of the inside panel 12 to project toward the second outside panel 11. More concretely, the cylindrical portion 113*a* in a compressed shape is formed at the front end portion of the second outside panel 11, the small projections 113*b*, 113*c* are formed at vertical two positions of a general center along back and forth, and the small projections 113*d*, 113*e* are formed at a rear end portion with a predetermined distance kept vertically. Each of the small projections 113*b*, 113*c*, 113*d*, 113*e* is in a shape of a small column with a small projecting height. A projecting height of the convex portion 115 arranged on the inside face of the second outside panel 11 is set lower than the projecting height of the small projections 113*b*, 113*c*, 113*d*, 113*e*. The small projections 124*a* and the cylindrical portions 124*b*, 124*c*, 124*d*, 124*e* are arranged at predetermined positions on the inside panel 12 so as to correspond to each shape and each portion of the cylindrical portion 113*a* and the small projections 113*b*, 113*c*, 113*d*, 113*e*. The small projection 124*a* locating at the front end portion is in a thin plate shape to correspond to a shape of the cylindrical portion 113*a* and each of the cylindrical portions 124*b*, 124*c*, 124*d*, 124*e* is in a general cylinder. In addition, the small projection 124*a* and the cylindrical portions 124*b*, 124*c*, 124*d*, 124*e* are arranged at a peripheral portion of the inside panel 12. In this embodiment, projecting portions 125*a*, 125*b* are integrally arranged on an outer circumferential face of the cylindrical portions 124*b*, 124*c* arranged vertically at a general center along back and forth. Each of the projecting portions 125*a*, 125*b* is in a shape of a partial ark in a plane view wherein the projecting portion 125*a* projects upward from the outer circumferential face of the cylindrical portion 124*b* and the projecting portion 125*b* projects downward from the outer circumferential face of the cylindrical portion 124*c*. In a state that the second outside panel 11 and the inside panel 12 are assembled, an upper edge of the projecting portion 125*a* is located a little below an upper edge of the second outside panel 11 and a lower edge of the projecting portion 125*b* is located a little above a lower edge of the second outside panel 11.

Figure 5:
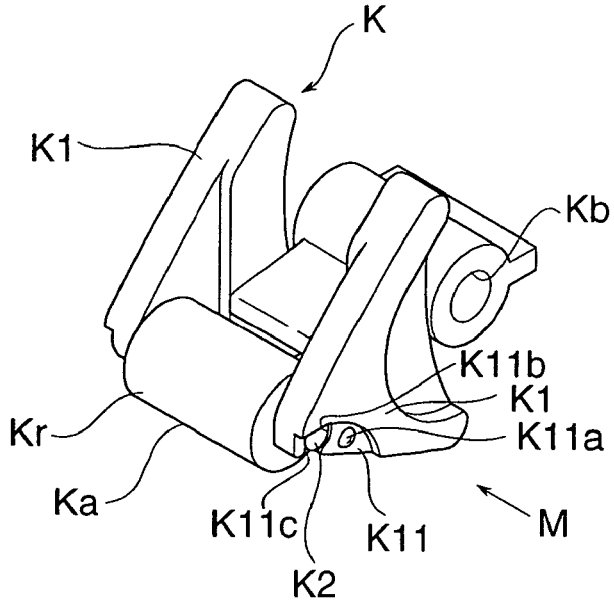
FIGS. 5*a*, 5*b*, and 5*c* are views is a view showing a transfer head in accordance with the embodiment.
Figure 5:
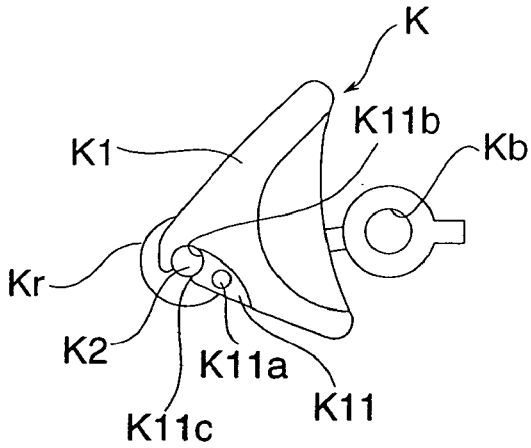
Figure 5:
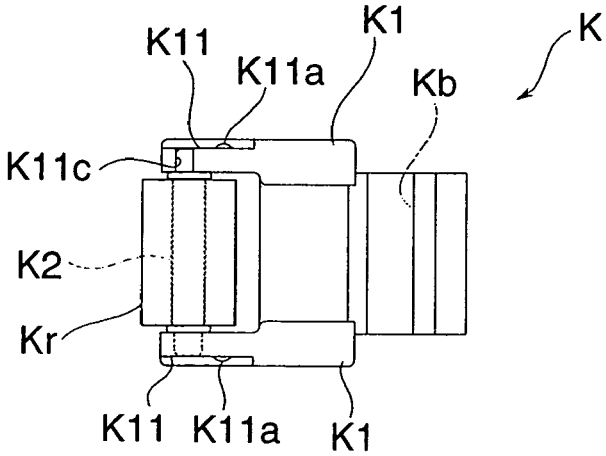

The transfer head K is so arranged that a roller Kr is held between a pair of facing panels K1 as shown in FIG. 5 (FIG. 5(*a*) shows a general perspective view, FIG. 5(*b*) shows a side view viewed from a direction of an arrow M, and FIG. 5(*c*) shows a bottom view.) More concretely, thin portions K11 are formed on each outer faces at a bottom portion of a pair of the facing panels K1 and through bores K11*b* are formed at a distal end portion of each thin portion K11. Both side portions of a rotational supporting axis K2 of the roller Kr are inserted into the through bores K11*b* respectively so that the roller Kr is rotatable around the rotational supporting axis K2. A cutout K11*c* is formed at a bottom edge of one of the through bores K11*b* to communicate with the through bore K11*b* so as to facilitate an operation of mounting the roller Kr and the rotational supporting axis K2. In other words, one side end portion of the rotational supporting axis K2 is inserted into other through bore K11*b* without a cutout K11*c*, and then other side end portion of the rotational supporting axis K2 is inserted into the former through bore K11*b* through the cutout K11*c*. In addition, a convex portion K11*a* is arranged on each thin portion K11 respectively to project outward. Each convex portion K11*a* is generally in a shape of a partial sphere and fits into a fitting bore C22 of the head cap C, to be described later, in case that the head cap C is located at the transfer head covering position (P). In this embodiment the distal end portion Ka indicates a distal end portion of the roller Kr held between the facing panels K1.

Figure 6:
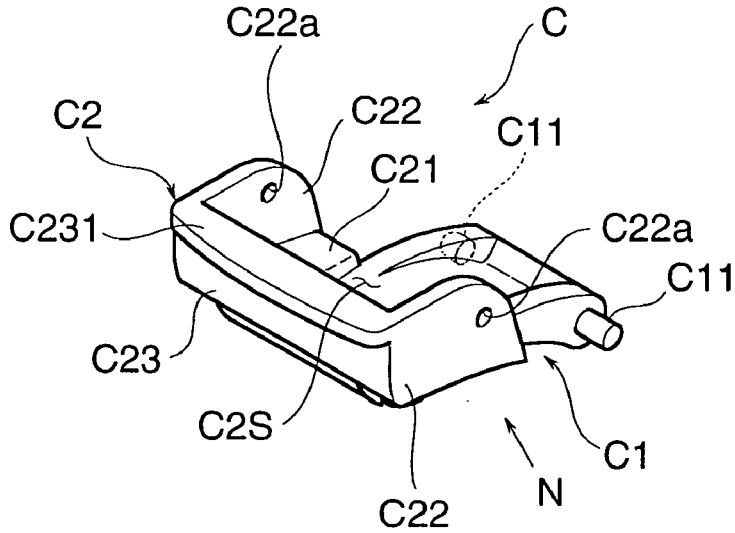
FIGS. 6*a*, 6*b*, and 6*c* are views is a view showing a head cap in accordance with the embodiment.
Figure 6:
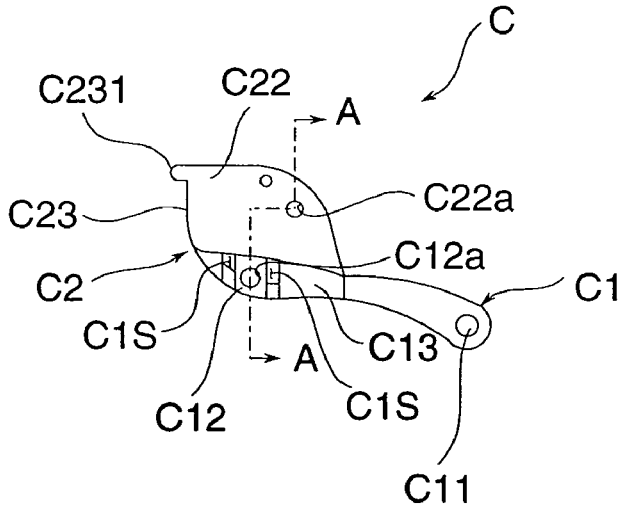
Figure 6:
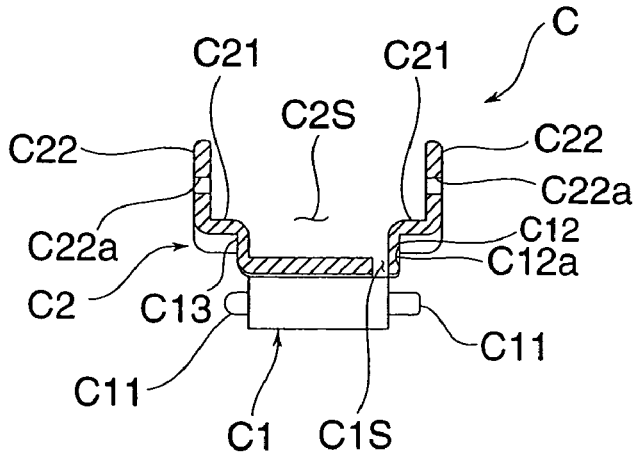

The head cap C has rotational supporting axiss C11 axially supported by through bores 110*a*, 120*a* formed on the elongating portions 110, 120 of the inside panel 12 at an area adjacent to its proximal end portion of the head cap C, as shown in FIG. 6 (FIG. 6(*a*) shows a general perspective view, FIG. 6(*b*) shows a side view viewed from a direction of an arrow N in FIG. 6(*a*), and FIG. 6(*c*) is a cross-sectional view taken along a line A—A in FIG. 6(*b*).) A term "proximal" or "rear" showing a position or a direction of the head cap C indicates a rear side of the transfer device A in case that the head cap C is located at the transfer head cap covering position (P), while a term "distal" or "front" indicates a front side of the transfer device A in case that the head cap C is located at the transfer head cap covering position (P). More concretely, the head cap C comprises an arm portion C1 that extends from the proximal end portion toward the front and an accommodating portion C2 that is integrally formed with a distal end portion of the arm portion C1 and that can accommodate the distal end portion Ka of the transfer head K at the transfer head cap covering position (P). The arm portion C1 is in a shape of a thin plate and in a shape extending toward a distal end portion and upward little by little with bending in a side view. The rotational supporting axis C11 are formed to project outward at both side end portions of a proximal end portion of the arm portion C1. The rotational supporting axis C11 is generally in a column shape with its diameter a little smaller than a diameter of the through bores 110*a*, 120*a* formed on the elongating portion 110 of the second outside panel 11 and the elongating portion 120 of the inside panel 12. In addition, standing members C13 are formed at both side edges from a general center along a longitudinal direction to the distal end portion of the arm portion C1 and an elastically transformable elastic portion C12 is formed at a part of one of the standing members C13. The elastic portion C12 has an arrangement of partially discontinuous to other portion of the standing member C13 due to a slit C1S formed continuously along its back and forth and inward so as to be able to bend a little by a force applied from outside (refer to FIG. 6(*b*), FIG. 6(*c*)). A concave portion C12*a* as being a fitting concave portion of the present claimed invention is formed at a general center portion of the elastic portion C12 to be dented. The concave portion C12*a* is circular in a side view and fits over the convex portion 115 arranged on the second outside panel 11 of the refillable cartridge 1 in case that the head cap C is located at the transfer head exposing position (Q). The accommodating portion C2 has a bottom panel C21 that extends from the upper end portion of the standing members C13 arranged at both side edge portions toward its side respectively in an area from a general center along a longitudinal direction to a distal end portion of the arm portion C1, a pair of facing panels C22 each of which stands at a side edge portion of the bottom panel C21 respectively and faces each other, and a front panel C23 that is arranged to connect each of front edge sides of the facing panels C22 so as to form an accommodating space C2S with opening upward and rearward. In addition, a fitting bore C22*a* as being a fitting concave portion of the present claimed invention is formed on an upper end portion of each facing panel C22 to penetrate thickness of the facing panels C22. The convex portion K11*a* arranged on facing panels K1 of the transfer head K fits in the fitting bore C22*a* in case that the head cap C is located at the transfer head covering position (P). An operating portion C231 is integrally arranged on the upper end portion of the front panel C23 so that a user can put his or her finger on the operating portion C231 in case of operating the head cap C to rotate. The head cap C of the above-mentioned arrangement is mounted rotatably around the rotational supporting axis C11 in a state of being tightly held between the second outside panel 11 and inside panel 12 by inserting the rotational supporting axis C11 into the through bores 110*a*, 120*a* formed on the extending portions 110, 120 of the second outside panel 11 and the inside panel 12 when the second outside panel 11 and the inside panel 12 are assembled.

The case 2 mainly comprises, as shown in FIG. 1~FIG. 4, a first outside panel 21 constituting an outside wall of the transfer device A in pairs with the second outside panel 11 and a pair of standing panels 22, 23 continuously arranged to an upper edge and a lower edge of the first outside panel 21 generally orthogonal to the first outside panel 21. Vertically arranged a pair of the standing panels 22, 23 are so set to generally close a space between the upper edge and the bottom edge of the second outside panel 11 in a state that the refillable cartridge 1 and the case 2 are assembled.

The first outside panel 21 is, like the second outside panel 11, for example, in a shape of a thin plate made of synthetic resin and is so arranged that a sliding member 3, to be described later, can be mounted on a rear end portion of the first outside panel 21, and in this embodiment, a side view in a state wherein the sliding member 3 is mounted on its rear end portion generally corresponds to a side view of the second outside panel 11 of the refillable cartridge 1. A wind-off gear G1 with a big diameter to drive to rotate the wind-off spool SP1 and the roll-up spool SP2 and a roll-up gear G2 that gears the wind-off gear G1 and that has a diameter smaller than that of the wind-off gear G1 are arranged at an inside face of the first outside panel 21. The wind-off gear G1 is mounted on an inside face of the first outside panel 21 by inserting a shaft 211 formed at the rear end portion of the first outside panel 21 into a through bore formed at a center portion of the wind-off gear G1 and then mounting a core H1 on the shaft 211 in a manner incapable of dropping out. The roll-up gear G2 has a core H2 integrally formed with the roll-up gear G2 and is mounted on the inside face of the first outside panel 21 by inserting a shaft 212 formed at a center portion along back and forth a little approaching the front end portion of the first outside panel 21 into a through bore formed at a center portion of the roll-up gear G2. A periphery of the core H1 gears an inner circumference of the wind-off spool SP1 and a periphery of the core H2 gears an inner circumference of the roll-up spool SP2 when the case 2 fits over the refillable cartridge 1. The slits 214 each of which extends back and forth are arranged vertically in pairs at a center portion of the first outside panel 21 and the sliding member 3, to be described later, is mounted in a manner of sliding movable along back and forth by making use of these slits 214.

Each of the standing panels 22, 23 has a predetermined thickness respectively and is integrally provided with grooves 221, 231 into which the projecting portions 125*a*, 125*b* arranged on the inside panel 12 of the refillable cartridge 1 can fit, and abutting members 222, 232 with which a peripheral portion of the inside face of the second outside panel 11 can make an abutting contact. The grooves 221, 231 are formed between a pair of ribs 221, and between a pair of ribs 231 each of which is arranged along a standing direction of the standing panel 22, 23, respectively, at predetermined portions corresponding to portions where the projecting portions 125*a*, 125*b* are arranged. Each groove 221, 23*a* is an opening edge whose one end portion opens toward the refillable cartridge 1 and is so arranged that the projecting portions 125*a*, 125*b* of the refillable cartridge 1 can be mounted or dismounted by making use of the opening edge. Each abutting member 222, 232 is formed at a distal end portion of the standing panel 22, 23 to project a little toward other standing panel 23, 22 generally parallel to the first outside panel 21. Each abutting member 222, 232 is arranged neither between the ribs 221*a*, nor between the ribs 231*a*. An opening edge of each abutting members 222, 232 opens toward the refillable cartridge 1. The abutting member 222, 232 is thin-walled so as to make the outside face of the standing panel 22, 23 and the outside face of the second outside panel 11 generally flat when the refillable cartridge 1 fits into the case 2.

The sliding member 3 is, as shown in FIG. 1 through FIG. 4, in a shape of an "L" character of synthetic resin comprising a side panel 31 that makes a sliding movement along a pair of vertically arranged slits 214 formed on the first outside panel 21, namely along a direction of back and forth of the first outside panel 21, and that is arranged along an outside face of the first outside panel 21, and an integrally formed operating panel 32 that is integrally formed with the side panel 31 and that is arranged to cover generally whole area of the rear end portion side of the case 2. An outside face of the side panel 31 is arranged so as to be flat to the outside face of the first outside panel 21. In order to do so, a predetermined area around the slit 214 on the outside face of the first outside panel 21 is dent to correspond to a shape of the side panel 31. In addition, the operating panel 32 is generally in a shape of a partial ark in a side view and bent along a shape of the rear end portion of the standing panel 22, 23 of the case 2. The fitting bore 321, into which the fitting nail 112 arranged at the rear end portion of the second outside panel 11 of the refillable cartridge 1 fits, is formed at a center portion of the inside face of the operating panel 32 and a pair of operating portions 322 are formed at both end portions on the outside face of the operating panel 32. In this embodiment, the operating portion 322 projects outward in order to facilitate hanging a user's finger, however, it may have a partial concave portion on its outside face. In addition, an unciform engaging member 323 is formed at one end portion of each operating panel 32 to project forward. At the rear end portion of the standing panel 22, 23 the case 2 has engaging bores 224, 234 that can make an engagement with the engaging member 323 in order to correspond to the sliding member 3 of the above arrangement. An engaging means is constituted by a pair of the engaging members 323, 323 and the engaging bores 224, 234 corresponding to the engaging members 323, 323. The sliding member 3 is stably held by the case 2 at a position where a sliding movement starts by engaging the engaging members 323, 323 with the engaging bores 224, 234 respectively. In accordance with the above-mentioned arrangement, the sliding member 3 is closely related to the refillable cartridge 1 due to a fitting arrangement of the fitting bore 321 and the fitting nail 112 and is engaged with the case 2 due to an engaging arrangement of the engaging member 323, 323 and the engaging bores 224, 234 in a state that the sliding member 3 is mounted on the case 2 and that the refillable cartridge 1 is assembled with the case 2.

When the transfer device A is slid toward a predetermined direction with contacting a surface of a paper or the like, the tape A held between the distal end portion Ka of the transfer head K and the surface of the paper is sent out from the wind-off spool SP1 that rotates together with the wind-off gear G1 due to frictional force and the paste adhered to one face of the tape body Ta is transferred on the surface of the paper. At the same time, the roll-up spool SP2 rotates together with the roll-up gear G2 that rotates to a counter direction in conjunction with the wind-off gear G1, and the tape body Ta that does not have paste on its face is rolled up by the roll-up spool SP1. If an appropriate tool or a writing material that has a spiculate portion at its distal end such as a driver or a pen is inserted into a chamfer, not shown in drawings, arranged intermittently along a circumference of the outside face of the roll-up spool SP1, and then the roll-up spool SP1 is rotated by the use of the appropriate tool or the writing material, a slack of the transferring paste T in the transfer device A can be adjusted due to a rotation of the wind-off spool SP2 in conjunction with the rotation of the roll-up spool SP1.

The transfer device A is so arranged that the refillable cartridge 1 and the case 2 can be separated by sliding the sliding member 3 toward a predetermined direction and a separating mechanism X is formed by making the refillable cartridge 1, the case 2 and the sliding member 3 mutually related. The separating mechanism X comprises a pair of projecting portions 311, 311 vertically arranged on an inside face of the side panel 31 so as to be inserted into the slits 214 vertically arranged on the case 2, and a pair of separation initiating portions 126, 126 vertically arranged on the inside panel 12 of the refillable cartridge 1 to face the case 2. Each of the separation initiating portions 126 is in a shape of a thin plate with forming a tapered face 126*a* inclining toward the front. In this embodiment, the tapered face 126*a* is generally in a partial arc in a plane view with forming a modest curve. Each of the separation initiating portion 126 is inserted into the slit 214 as being a traveling path of the projecting portion 311 so as to be in ready. Each of the projecting portion 311 is in an unciform shape of a thin plate with forming a tapered face 311*a* inclining toward the rear. The tapered face 311*a* is generally in a partial arc with forming a modest curve corresponding to the tapered face 126*a* of the separation initiating portion 126. In addition an accommodating portion 127 is formed on the outside face of the inside panel 12 that can accommodate a distal end portion of the projecting portion 311 in a state that the sliding member 3 is located at a sliding start position in order to hold the sliding member 3 at the sliding start position when the transfer device A is in use. (refer to FIG. 3, FIG. 4).

In order to avoid the sliding member 3 from dropping out in conjunction with a sliding movement of the sliding member 3, a pair of small projecting portions 312, 312 are formed vertically on the sliding member 3 to be inserted into the slits 214 at a position rearward to the projecting portion 311 so as to make an abutting contact with a stopper portion, not shown in drawings, formed on the slit 214 when the sliding member 3 is slid rearward by a predetermined distance (at a sliding end position). As the stopper portion, an arrangement may be such that an opening width of the slit 214 is set to be narrow so that the small projecting portion 311 makes an abutting contact or that an opening edge of the slit 214 is utilized.

Next, a procedure to separate the refillable cartridge 1 from the case 2 will be explained with reference to FIG. 7.

Figure 7:
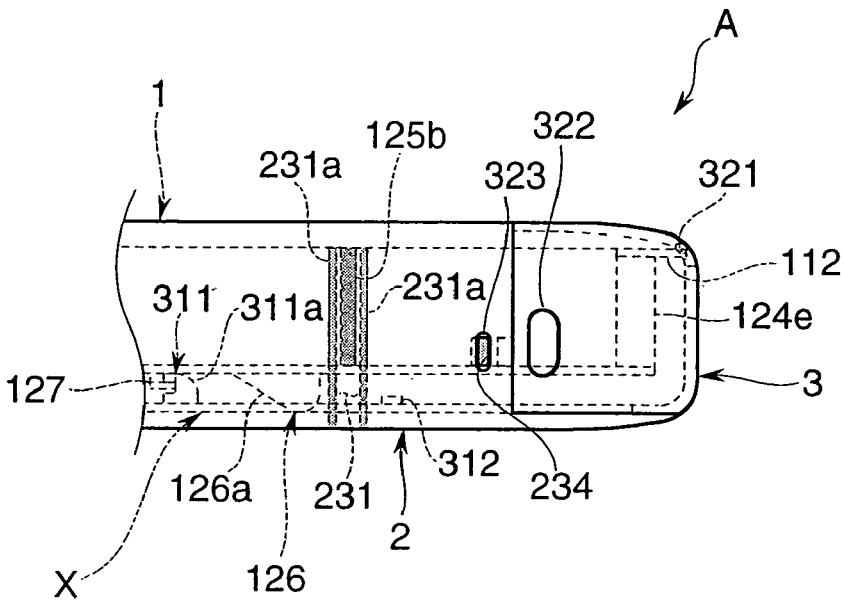
FIGS. 7*a* and 7*b* are explanatory views is an explanatory view of an operation of the embodiment.
Figure 7:
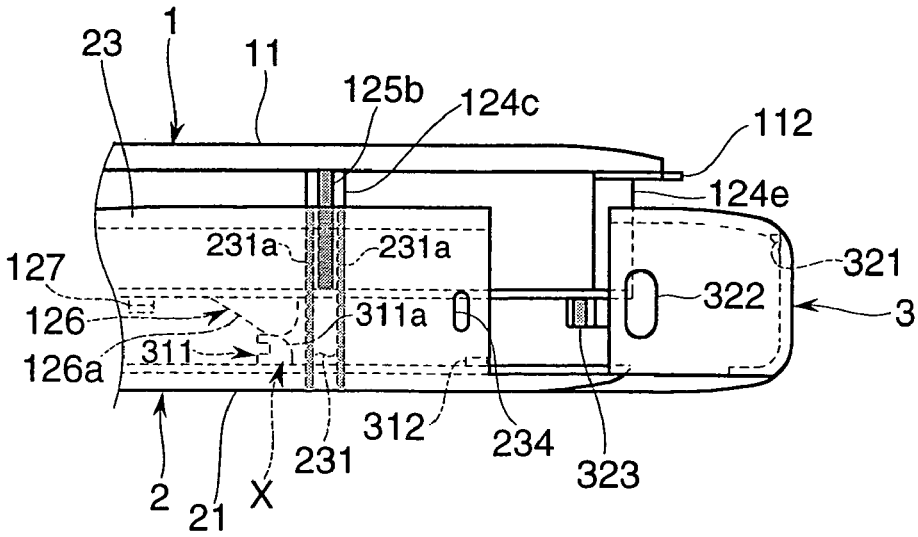

FIG. 7 is a magnified plane view of a principal part with some part omitted to draw. First, in a state that the refillable cartridge 1 and the case 2 are assembled (refer to FIG. 7(*a*)), the standing panels 22, 23 of the case 2 are held with one hand and the sliding member 3 locating at the sliding start position is slid rearward relative to the case 2 with pushing a pair of the operating portions 322, 322 arranged on the sliding member 3 to approach each other with the other hand. In conjunction with this operation, an engaged state of the engaging member 323 and the engaging bore 224, 234 (an engaged state by the engaging means) and an engaged state of the fitting nail 112 and the fitting bore 321 are released respectively, and then the projecting portion 311 of the sliding member 3 starts to interfere the separation initiating portion 126 arranged on the inside panel 12 of the refillable cartridge 1. Additional movement to slide the sliding member 3 rearward makes the tapered face 311*a* of the projecting portion 31 abutting contact with the tapered face 126*a* of the separation initiating portion 126 and the sliding member 3 climbs over the inside panel 12 of the refillable cartridge 1 little by little (refer to FIG. 7(*b*)). In this case, a pair of the projecting portions 125*a*, 125*b* arranged on the inside panel 12 are guided by the grooves 221, 231 formed on the standing panels 22, 23 of the case 2 so that the refillable cartridge 1 is gradually separated from the case 2 toward a direction orthogonal to the direction of sliding the sliding member 3 in a generally linear manner. When the sliding member 3 reaches the sliding end position by further making a sliding movement rearward by a predetermined distance, the small projecting portion 312 of the sliding member 3 makes an abutting contact with a stopper portion, not shown in drawings, formed in the slit 214, which restrains the sliding member 3 from further making a sliding movement. In this state, the refillable cartridge 1 and the case 2 can be separated by moving the refillable cartridge 1 along a direction generally orthogonal to the direction of sliding the sliding member 3. In order to mount a new refillable cartridge 1 on the case 2, all needed is just to move the new refillable cartridge 1 to gradually approach the case 2 with the projecting portion 125*a*, 125*b* of the new refillable cartridge 1 guided by the grooves 221, 231 formed on the standing panels 22, 23 of the case 2. In conjunction with this operation, the new refillable cartridge 1 moves in a generally linear state along a direction generally orthogonal to the direction of sliding the sliding member 3 and then the inside face of the second outside panel 11 of the new refillable cartridge 1 makes an abutting contact with the abutting members 222, 232 arranged on the standing panels 22, 23 of the case 2. (The abutting member is omitted to draw in FIG. 4.) In this case, each of the grooves 221, 231 also serves as a mounting guiding portion for suggesting a portion on which the new refillable cartridge 1 be mounted. Furthermore, when the new refillable cartridge 1 is mounted on the case 2, first, the sliding member 3 is moved toward the sliding starting position beforehand; next, the new refillable cartridge 1 is mounted on the case 2; and then the sliding member 3 is moved further forward until it reaches the sliding starting position. Due to this operation, the fitting nails 112 arranged on the outside panel 11 of the new refillable cartridge 1 fits into the fitting bore 321 formed on the sliding member 3, and the engaging bore 224, 234 engages with the engaging member 323 arranged on the sliding member 3, which assures a stable state of the new refillable cartridge 1 mounted on the case 2. In addition, in order to mount the new refillable cartridge 1 on the case 2, when the sliding member 3 is located at the sliding end position, the following operation may be conducted; the new refillable cartridge 1 may be moved to approach the case 2 with the projecting portions 125*a*, 125*b* of the new refillable cartridge 1 guided by the grooves 221, 231 of the case 2, which transitionally makes the tapered face 126*a* of the separation initiating portion 126 of the new refillable cartridge 1 interfere the tapered face 311*a* of the projecting portion 311 of the sliding member 3 each other, and the new refillable cartridge 1 is further moved to approach the case 2. In conjunction with this operation, the sliding member 3 makes a sliding movement forward relative to the case 2.

In this embodiment, the head cap C is set to be rotatable between the transfer head covering position (P) and the transfer head exposing position (Q).

Next, a method for operating the head cap C will be explained.

First, in order to put the rotatable head cap C at the transfer head covering position (P), the head cap C is rotated upward around the rotational supporting axis C11 with gripping the operating portion C231 arranged at the front end portion of the head cap C. Then the convex portion K11*a* arranged on the facing panel K1 of the transfer head K slightly interferes the inside face of the facing panel C22 constituting the accommodating portion C2 of the head cap C mutually. Further operation to rotate the head cap C to the same direction will make the convex portion K11*a* of the transfer head K fit into the fitting bore C22*a* of the head cap C so as to engage the head cap C with the transfer head K. As a result, the head cap C is held at the transfer head covering position (P) with its posture kept. In this case, the concave portion K11*a* of the transfer head K and the fitting bore C22*a* of the head cap C serves as the first engaging means I of the present claimed invention that engages the head cap C with the transfer head K at the transfer head covering position (P). At the transfer head covering position (P), since the distal end portion Ka of the transfer head K is accommodated in the accommodating space C2S of the accommodating portion C2 of the head cap C, the transfer paste T is protected, and since the arm portion C1 covers a portion which is to be used of the transfer paste T from downward, the portion of the transfer paste T is also protected. In order to put the head cap C, locating at the transfer head covering position (P), at the transfer head exposing position (Q), the head cap C is rotated downward around the rotational supporting axis C11 with gripping the operating portion C231 of the head cap C. Then an engaged state (an engaged state of the first engaging means I) of the convex portion K11*a* of the transfer head K and the fitting bore C22*a* of the head cap C is released, the distal end portion of the arm portion C1 of the head cap C goes into a space between the second outside panel 11 and the inside panel 12, and then the convex portion 115 arranged on the inside face of the second outside panel 11 slightly interfere the elastic portion C12 arranged on the arm portion C1 of the head cap C. Further operation of rotating the head cap C to the same direction will make the elastic portion C12 of the head cap C bent a little, and furthermore operation of rotating the head cap C to the same direction will make the concave portion C12*a* formed on the elastic portion C12 fit over the convex portion 115 of the second outside panel 11 so that the head cap C engages with the second outside panel 11. In other words, the head cap C engages with the second outside panel 11 by fitting the concave portion C12*a* formed on the elastic portion C12 over the convex portion 115 of the second outside panel 11. As a result, the head cap C is held at the transfer head exposing position (Q) with its posture kept. In this case, the convex portion 115 of the second outside panel 11 and the concave portion C12*a* of the head cap C serve as the second engaging means II of the present claimed invention that engages the head cap C with the second outside panel 11 at the transfer head exposing position (Q). At the transfer head exposing position (Q), the distal end portion Ka of the transfer head K is in a state of being exposed. In order to put the head cap C locating at the transfer head exposing position (Q) at the transfer head covering position (P), the head cap C is rotated to a counter direction to the above case around the rotational supporting axis C11 with gripping the operating portion C231 of the head cap C. Then an engaged state (an engaged state of the second engaging means II) of the convex portion 115 of the second outside panel 11 and the concave portion C12*a* of the head cap C is released. Further operation to rotate the head cap C by a predetermined angle will make the convex portion K11*a* of the transfer head K fits into the fitting bore C22*a* of the head cap C so that the head cap C is held at the transfer head covering position (P). In this embodiment, since the head cap C itself is held by the refillable cartridge 1 in either case that the head cap C is located at the transfer head covering position (P) or at the transfer head exposing position (Q), the head cap C does not interfere the case 2 during an operating of separating the refillable cartridge 1 from the case 2. Further, the head cap C is so set not to interfere the case 2 during an operation of rotating the head cap C between the transfer head covering position (P) and the transfer head exposing position (Q).

As mentioned above, since the transfer device A of the present claimed invention has an arrangement wherein the rotational supporting axis C11 arranged on the head cap C is axially mounted on the through bore 110*a* formed on the second outside panel 11 and the through bore 120*a* formed on the inside panel 12 and the head cap C is tightly held by the second outside panel 11 and the inside panel 12, the head cap C is located between the second outside panel 11 and the inside panel 12 through the rotational supporting axis C11. Then a strength of assembling the second outside panel 11 and the inside panel 12 at the front end portion can be improved and a rigidity of the front end portion can effectively be improved. As a result, it is possible to avoid a possibility that the second outside panel 11 and the inside panel 12 bend to approach each other with a simple arrangement when the transfer device A is in use or dropped, resulting in superior practicality. In addition, since the transfer device A is so arranged that the rotational supporting axis C11 is inserted into the through bores 110*a*, 120*a* arranged on the second outside panel 11 and the inside panel 12, it is possible to mount the head cap C with ease compared with an arrangement that a head cap is mounted on a transfer head.

Especially, since the transfer device A mainly comprises the refillable cartridge 1 and the case 2 that accommodates the refillable cartridge 1 detachably and the transfer paste T, and the transfer head K and the head cap C are held between the second outside panel 11 and the inside panel 12 constituting the refillable cartridge 1, it is possible to exchange the head cap C together with the transfer head K by an operation of exchanging the refillable cartridge 1. Due to this arrangement, the head cap C can be exchanged to a new head cap C together with the transfer head K easily by exchanging the refillable cartridge 1 when the transfer paste T attaches to the head cap C. If the head cap is mounted on a case, in order to exchange the refillable cartridge an operation to evacuate the head cap to a predetermined position every time the refillable cartridge is exchanged is required so that the head cap does not interfere the transfer head. However, in accordance with this arrangement, since both of the head cap C and the transfer head K are held by the refillable cartridge 1, the operation to evacuate the head cap to a predetermined position is not required in case of exchanging the refillable cartridge 1, thereby to make an operation to exchange the refillable cartridge 1 more smooth.

In addition, since the head cap C is set not to interfere the case 2 during an operation of rotating the head cap C between the transfer head covering position (P) and the transfer head exposing position (Q), the head cap C can be rotated in a good condition. Furthermore, since no component is damaged due to interference between the head cap C and the case 2, the transfer device A can have a longer operating life.

In addition, since the refillable cartridge 1 can be detachably mounted on the case 2 in either cases that the head cap C is located at the transfer head covering position (P) and the transfer head exposing position (Q), a troublesome operation of the head cap C to evacuate to a predetermined position every time the refillable cartridge 1 is exchanged so that the head cap C does not interfere the case 2 in exchanging the refillable cartridge 1 can be effectively avoided, thereby to further improve convenience of exchanging the refillable cartridge 1.

Since the head cap C is provided with the accommodating portion C2 that can accommodate the distal end portion Ka of the transfer head K and the arm portion C1 that extends from the accommodating portion C2 toward a side of the rotational supporting axis C11 and that can cover a portion which is to be used of the transfer paste T, it is preferable that the arm portion C1 can cover not only the distal end portion Ka of the transfer head K but also a portion which is to be used of the transfer paste T. In addition, since an operating portion C231 to which a user can hook his or her finger in case of operating the head cap C to make a rotary movement is arranged in the accommodating portion C2, the operating portion C231 is set to locate at a position separated from the rotational supporting axis C11 by a predetermined distance. As a result, the head cap C can be rotated with a little operating force applied to the operating portion C231, thereby to make it possible to rotate the head cap C with a light touch and to improve usability.

Furthermore, since the operating portion C23 is integrally formed with the accommodating portion C2, a number of components can be reduced and strength of the operating portion C231 can be effectively improved as well.

In addition, since the rotational supporting axis C11 is integrally formed with the head cap C, both a number of components and a cost can be reduced, and an operation of mounting the rotational supporting axis C11 on the head cap C can be effectively simplified.

Since the head cap C is restricted from making a rotary movement through the first engaging means I that engages the head cap C with the transfer head K at the transfer head covering position (P), it is possible to lock the head cap C at the transfer head covering position (P) when the transfer device A is not in use and also possible to prevent the transfer paste T from improperly attaching to a surface of paper or other component. In addition, since the head cap C is restricted from making a rotary movement through the second engaging means II that engages the head cap C with the second outside panel 11 at the transfer head exposing position (Q), it is possible to prevent the head cap C from improperly making a rotary movement, thereby to be superior in practical use.

Especially, since the first engaging means I has an arrangement of comprising the fitting bore C22*a* formed on the head cap C and the convex portion K11*a* formed on the transfer head K, it is possible to form the first engaging means I with a simple arrangement and also possible to improve an engaged state of the head cap C and the transfer head K by fittingly inserting the convex portion K11*a* into the fitting bore C22*a*.

In addition, since the second engaging means II has an arrangement of comprising the fitting bore C12*a* formed on the head cap C and the convex portion 115 formed on the second outside panel 11, it is also possible to form the second engaging means II with a simple arrangement and also possible to improve an engaged state of the head cap C and the second outside panel 11 by fittingly inserting the convex portion 115 into the fitting bore C12*a*.

The present claimed invention is not limited to the above-described embodiments.

For example, a rotational supporting axis is arranged on the second outside panel 11 and/or the inside panel 12 (hereinafter called as a pair of the side panels) and a bore portion as being a bearing portion into which the rotational supporting axis is formed on the head cap and the head cap may be tightly held by a pair of the side panels by axially mounting the rotational supporting axis on the bore portion. In this case, a rotational supporting axis may be arranged on both of the side panels to project toward the other side panel, or a rotational supporting axis may be arranged on either one of the side panels to project toward the other side panel. Especially for the later case, it is preferable that a holding portion that can hold a distal end portion of the rotational supporting axis is arranged appropriately on the other side panel.

In addition, a convex portion constituting the first engaging means may be formed on the head cap and a fitting concave portion that can fit over the convex portion may be formed on the transfer head. Furthermore, a convex portion constituting the second engaging means may be formed on the head cap and a fitting concave portion that can fit over the convex portion may be formed on a pair of the side panels. With this arrangement of the first engaging means and the second engaging means, the same effect can be obtained as that of the above-mentioned embodiment. In addition, each of the fitting concave portion of the first engaging means and the fitting concave portion of the second engaging means may be in any shape as far as the corresponding convex portion can fit into such as a through bore penetrating along a direction of a thickness of the component, a dent whose wall thickness is thinner that that of its adjacent area, or a groove having a bottom. Likewise, it is a matter of course that a shape of the convex portion is not limited to the above embodiments.

In the above embodiment, the transfer device A comprising the refillable cartridge 1 and the case 2 is explained, however, a transfer device may be expendable. In this case, the same effect as that of the above-mentioned embodiment can be obtained if a head cap is held by a pair of the side panels constituting an outside wall of the transfer device, a rotational supporting axis arranged on either one of the side panels and the head cap is axially mounted on a bearing portion formed on the other and the head cap is tightly held by a pair of the side panels.

A shape of the head cap may be so set as to cover all of the distal end portion of the transfer head at the transfer head covering position.

The transfer paste as the transferring material may be solid or liquid, and can be applied to a correction tape, an adhesive tape, a tape that does not have adhesiveness, a binding material, and a general transferring material to be transferred to an object on which the transferring material is to be transferred.

Other concrete arrangement is not limited to the above embodiments and may be variously modified without departing from the spirit of the invention.

As mentioned above, in accordance with the transfer device of the present claimed invention, even though the opening portion is arranged near the transfer head in order to introduce the transferring material into the transfer head from inside the transfer device, the rotational supporting axis of the head cap is located between a pair of the side panels, thereby to strengthen a portion where the rotational supporting axis is mounted. In addition, since this arrangement does not require a process of mounting the head cap on the transfer head which requires a precise operation, it is possible to assemble the transfer device smoothly.

The invention claimed is:

1. A transfer device used for transferring a transferring material on an object on which the transferring material is to be transferred, and characterized by comprising a transfer head that makes the transferring material contact with the object, a pair of side panels that hold the transfer head and the transferring material, and a head cap that is rotatable between a transfer head covering position where a distal end portion of the transfer head can be covered and a transfer head exposing position where the distal end portion of the transfer head can be exposed, wherein a rotational supporting axis arranged on either a pair of the side panels or the head cap is axially mounted on a bearing portion formed at the other of a pair of the side panels or the head cap and the head cap is tightly held by a pair of the side panels; the transfer device further comprising a refillable cartridge that holds the transferring material, the transfer head, and the head cap between a pair of the side panels, and a case that detachably accommodates the refillable cartridge.

2. The transfer device described in claim 1, wherein the head cap is so set not to interfere with the case while the head cap is in motion to make a rotary movement between the transfer head covering position and the transfer head exposing position.

3. The transfer device described in claim 1, wherein the refillable cartridge is so arranged to be detachable from the case in either case that the head cap is located at the transfer head covering position or the transfer head exposing position.

4. The transfer device described in claim 1, wherein the head cap comprises an accommodating portion that can accommodate the distal end portion of the transfer head at the transfer head covering position, and an arm that extends from the accommodating portion toward the rotational supporting axis and that can cover a portion which is to be used of the transferring material at the transfer head covering position, and an operating portion to which a user can hook his or her finger in operating the head cap to make a rotary movement is arranged in the accommodating portion.

5. The transfer device described in claim 4, wherein the operating portion is integrally formed with the accommodating portion.

6. The transfer device described in claim 1, wherein the rotational supporting axis is integrally formed with a pair of the side panels or the head cap.

7. The transfer device described in claim 1, wherein the head cap is restricted from making a rotary movement through a first engaging means that engages the head cap with the transfer head at the transfer head covering position.

8. The transfer device described in claim 1, wherein the head cap is restricted from making a rotary movement through a second engaging means that engages the head cap with the side panel at the transfer head exposing position.

9. The transfer device described in claim 7, wherein the first engaging means comprises a convex portion arranged at either one of the head cap and the transfer head, and a fitting concave portion that is arranged at the other and that can fit over the convex portion.

10. The transfer device described in claim 8, wherein the second engaging means comprises a convex portion arranged at either one of the head cap and the side panel, and a fitting concave portion that is arranged at the other and that can fit over the convex portion.

11. The transfer device described in claim 9, wherein the fitting concave is a through bore penetrating toward a direction of a thickness.

12. The transfer device described in claim 10, wherein the fitting concave is a through bore penetrating toward a direction of a thickness.

13. The transfer device described in claim 9, wherein the fitting concave is formed by denting an adjacent area of a predetermined area.

14. The transfer device described in claim 10, wherein the fitting concave is formed by denting an adjacent area of a predetermined area.

15. The transfer device described in claim 9, wherein an elastic portion that can bend due to a force applied from outside is arranged at a predetermined area of a member that has the fitting concave portion, and the fitting concave portion is arranged at a predetermined portion of the elastic portion.

16. The transfer device described in claim 10, wherein an elastic portion that can bend due to a force applied from outside is arranged at a predetermined area of a member that has the fitting concave portion, and the fitting concave portion is arranged at a predetermined portion of the elastic portion.

17. The transfer device described in claim 15, wherein a predetermined slit is arranged at an adjacent area of the elastic portion.

18. The transfer device described in claim 16, wherein a predetermined slit is arranged at an adjacent area of the elastic portion.

* * * * *